United States Patent [19]

Poli et al.

[11] 4,286,895

[45] Sep. 1, 1981

[54] UNDERWATER PAVING MACHINE AND CONCRETE BLOCKS THEREFOR

[76] Inventors: Giovanni Poli; Vincenzo Poli, both of Via Sacca 1, Colorno (Parma), Italy

[21] Appl. No.: 52,227

[22] Filed: Jun. 26, 1979

[30] Foreign Application Priority Data

Jun. 29, 1978 [IT] Italy ..... 42514 A/78

[51] Int. Cl.[3] ..... E02B 3/12

[52] U.S. Cl. ..... 405/17; 405/16

[58] Field of Search ..... 405/15–35

[56] References Cited

U.S. PATENT DOCUMENTS

| | | | |
|---|---|---|---|
| 1,956,967 | 5/1934 | Upson | 405/17 |
| 2,502,757 | 4/1950 | Shearer | 405/17 |
| 2,570,271 | 10/1951 | Pickett | 405/17 |
| 2,834,186 | 5/1958 | Frerichs et al. | 405/17 |

*Primary Examiner*—Dennis L. Taylor

*Attorney, Agent, or Firm*—Haseltine & Lake

[57] ABSTRACT

An underwater paving machine for making fillings on the river beds is provided comprising a boat having a platform carrying a working structure comprising a pair of uprights supporting a horizontal shaft driven by a motor and carrying a number of spools on which rolls of cables or wires are wound. Said cables or wires are intended to carry blocks made of vibrated concrete and initially supported by a cage intended to be anchored on the river bed. The cage with the blocks are sinked into the water so as to form the fillings on the river bed. The tension of cables or wires is controlled by independent clutches associated to the spools. The blocks are coupled to each other by fastening means both in horizontal and vertical directions. In the area of the boat mounting the working structure an enlargement of the hull is provided intended to increase the buoyancy of the boat. A pair of lateral tanks serve to stabilize the boat on the sides thereof.

9 Claims, 6 Drawing Figures

17
18
19
20
21
22
23
24
25
26
27
28

UNDERWATER PAVING MACHINE AND CONCRETE BLOCKS THEREFOR

In order to make fillings where the river or run streams have removed soil due to the action of raging waters during floods and usual mattresses designed to this purpose are known.

The mattresses used up to now are made in situ, near the river in suitable fork shaped patterns in order to shape and make the mattresses equal to each other and for a possible control of the employed materials. The start materials employed in the construction of the mattresses are essentially two: fascines and natural or crushed stones. The fascines have reached by this time a high cost because they begin to be lacking and are to be collected in the woods by hand and then transported to the working site. The natural or crushed stones have also a very high cost because they can be found in the river or run beds in summer or else in the mountains where it is necessary to explode a mine in order to be able to make the material easily transportable and ready-to-use. After having mentioned the cost of the mattress it will be remembered that in order to lay it in the desired location, i.e. where it is desired to make a filling, a very great equipment is required with attendant high operation and maintenance costs. As a matter of fact, it is necessary to have a tilting platform mounted on great boats, which permits the mattresses to be thrown down in the rivers and since they are not guided they do not place themselves always in the desired position, but are dragged by the river stream to the most disparate locations, thereby compelling the operators to throw down in the water a great amount of mattresses to sometimes obtain only small fillings.

The object of this invention is to provide an underwater paving machine employing vibrated concrete blocks which obviates the above-mentioned disadvantages by means of a simple and economical solution thereof.

This is obtained according to the invention by providing suitable vibrated concrete blocks and a special boat designed to lay the blocks on the river beds and to form from above a paving proper also in the presence of irregular beds.

Therefore the invention is also directed to the construction of special concrete blocks by means of known vibrating presses on the site where the blocks must be employed, thereby eliminating most of the transports necessary to the construction of the prior mattresses in that the crushed stones sometimes can be available directly from the river and the concrete is transported on site loaded in bulk within containers which can have also great dimensions thereby affording a great autonomy. In order to lay said concrete blocks the invention contemplates the construction of a special boat having in the bow region a pair of support elements adapted to support a shaft to which spools are keyed spaced to each other the same distance, each of the spools having a separate clutch in order to make them independent of each other.

On the right side of the shaft a reduction gear is mounted, which in turn is driven by a motor through a clutch.

On both sides of the boat, near the bow, a pair of adjustable tanks are provided and the boat bottom in the bow region is concave with respect to the stern so as to impart a higher buoyancy to the boat.

In the spools keyed to the shaft steel cables or wires are wound, which permit the first connection by fastening to the cables or wires by means of a clamp a suitable cage provided with vertical and horizontal pointed rods and designed to support the first concrete blocks. The blocks are connected to each other in the horizontal direction by means of U-shaped steel stirrups and in the vertical direction by means of omega-shaped stirrups, which are previously prepared. On the boat platform a pair of reels are provided designed to contain a sufficient roll of steel cable or wire to accomplish the loading of the spools.

The constructive and operational features of the invention will be more apparent from the following detailed description in connection with the accompanying drawings in which a preferred embodiment of the invention is shown by way of example only and therefore not intended in a limiting sense.

Figure 1:
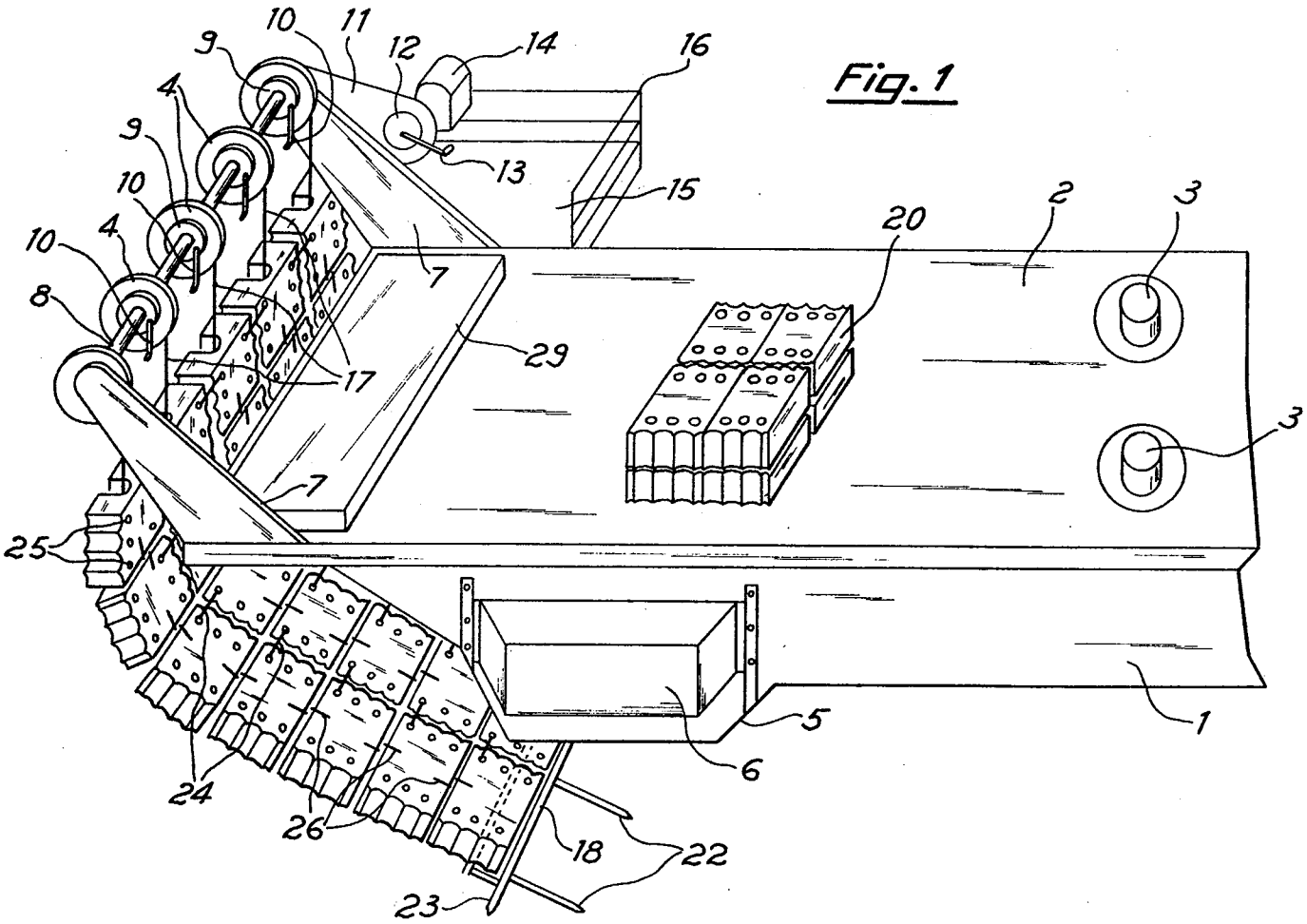
FIG. 1 shows a perspective view of an embodiment of this invention looking from the left side.

Referring now to the drawings, there is shown a boat 1 provided with a platform 2, carrying a pair of reels 3 serving to receive rolls of cables or wires. The boat 1 has a bottom shaping 5 serving to impart a higher buoyancy thereto in the location where it is more loaded, i.e. where the working structure is provided.

To the sides of the boat 1 a pair of opposed adjustable tanks 6 are applied which will be more or less sinked in the water so as to keep the load bearing platform 2 horizontal. On the bow region of the boat a pair of lateral supports 7 are mounted which support a shaft 8 to which five spools 4 are keyed, which will be loaded with steel cable or wire and these spools can be made idle with respect to the shaft 8 by means of clutches 9 operated by handles 10.

Keyed to the shaft 8 is a reduction gear 11, the function of which is to facilitate the braking action of the shaft 8 carrying the spools 4. In the reduction gear 11 a clutch 12 is mounted, serving to idle by means of a lever 13 the shaft 8 carrying the spools 4. Coupled to the reduction gear 11 is a motor 14 which will be actuated to load the spools 4. The boat 1 is provided with a landing 15 having a protection railing 16 in order to permit the operator to actuate the clutch lever 13 and the motor 14.

From the spools 4 the cables or wires 17 are vertically unwound which are fastened by means of clamps 19 to a cage 18, which acts as a support for the first horizontal row of blocks 20 or 21 as the case may be. To this cage 18 pointed rods 22 and 23 are welded which serve to anchor the first rows of blocks to the river bottom.

Figures 2, 3, 4, 5, 6:
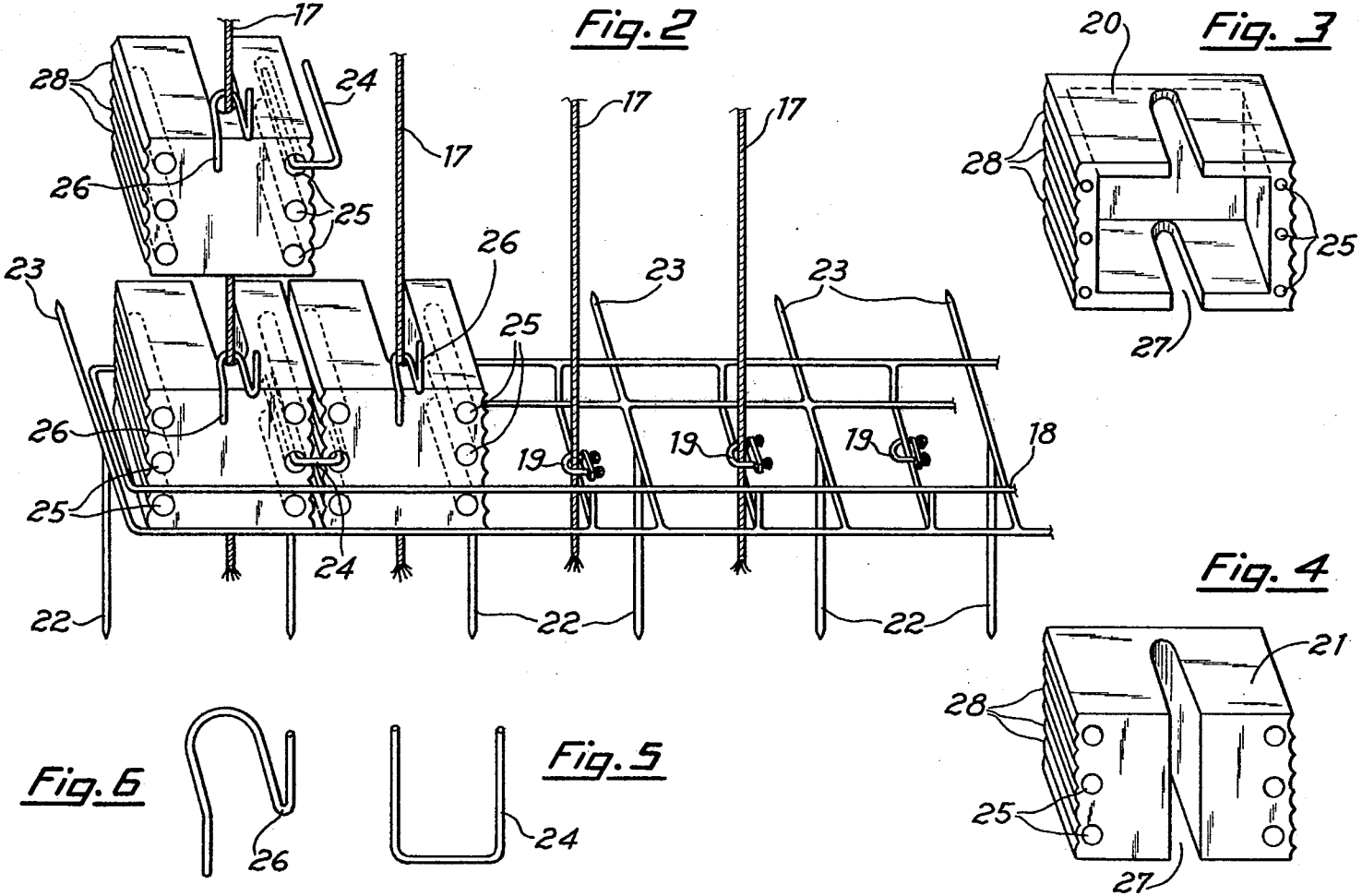
FIG. 2 shows a cage serving to cary-out the first loading of the concrete blocks.
FIG. 3 shows a lightened concrete block provided with slots and hooking holes.
FIG. 4 shows a solid concrete block provided with slots and hooking holes.
FIG. 5 shows a U-shaped stirrup for the horizontal connection of the blocks.
FIG. 6 shows a omega-shaped stirrup for the vertical connection of the blocks.

The blocks are coupled to each other side by side by means of a U-shaped steel stirrup 24 one leg of which is inserted into a hole 25 of a block and the other leg into a hole 25 of an adjacent block whereas the blocks 20 or 21 are coupled to each other endwise by means of a omega-shaped steel stirrup 26. On the boat 1 there is an adjustable floor 29 to permit the operator to be always in a good position for inserting the blocks. The block 20 shown in FIG. 3 is internally lightened in order to make it less expensive and easier to handle and is provided with the above mentioned holes 25 on both sides and a central slot 27 adapted to receive the cable or wire 17. The block 20 is provided on both sides with projections 28 designed to slow down the velocity of the water passing therebetween once the blocks are laid side by side on the river bed, thereby promoting the decantation of sand or earth contained in the river water.

The block 21 shown in FIG. 4 differs from the block 20 in that it is solid and is adapted to lay load bearing pavements.

The operation of the paving machine according to the invention is as follows: the boat 1 must be conducted to the desired location of the river and anchored in this location. Then the cable or wire rolls are applied on the reels 3, the motor 14 is started, the ends of the cables or wires from the reels 3 are fixed to the spools 4 and the latter are rotated by means of the motor until the spools are suitably loaded with cable or wire.

Then, the cage 18 is fastened by means of the clamps 19 to the ends of the cables 17, as shown in FIG. 2 and blocks 20 or 21 of block stack on the platform 2 are placed into the cage 18 with the cable 17 being inserted into the slot 27 of block 20 or 21, and this operation is repeated until the cage is filled. The blocks will be coupled side-by-side to each other by means of the U-shaped stirrups 24 the legs of which are inserted into the holes 25 of adjacent blocks as is shown in FIG. 2, and then the blocks are coupled endwise to each other by means of the omega-shaped stirrups 26 serving to keep the cable 17 in abutment with the bottom of slot 27 by means of two superimposed blocks and these operations are repeated until the filling is ended.

When two rows of blocks are completely mounted, these will be sinked in the water. The spools 4, even if provided with separate clutches 9, during the loading operation remain locked to the shaft 8 and therefore when the clutch 12 is disengaged the shaft 8 will rotate under the action of the force exerted by the blocks suspended by means of the cables or iron wires to the spools 4, and the shaft rotation will rotate the reduction gear 11. During these operations the motor 14 is stopped and it is started for loading the spools 4 only.

As the loading of blocks proceeds a concrete block carpet proper is provided and when the pointed rods 22 of the cage 18 are driven into the river bed the cable anchoring the boat 1 is loosened so as the boat can advance under the force of the river stream.

As the loading of blocks proceeds the block carpet will lay on the river bed and the pointed rods 23 will be driven into the river bed, thereby giving the possibility of weighing anchor.

As the block carpet is advancing on the river bed, it will meet differences of deep and in this case the operator on the adjustable floor of the platform of the boat 1 will see, for example, that some cables are becoming tight and some other cables are becoming loose, which means that on the river bed there is a valley at the tight cables and a rise at the loose cables. Where a cable is tight the operator must slowly disengage the clutch 9 associated to the spool 4 belonging to this cable and this spool will rotate on the shaft 8 until the cable of said spool will resume the tension of the other cables. These fillings can be laid also in stagnant water by applying an engine to the boat which permits the boat to advance.

It should be understood that this invention is not limited to the above described embodiment and that various changes and modifications can be made thereto without departing from the scope of the appended claims.

What we claim is:

1. An apparatus for forming and laying an endless, flexible underwater mat consisting of wire and preformed slotted blocks comprising:

a mat laying barge, a pair of upwardly and outwardly extending arms at the edge of the laying barge, a rotating shaft supported by the arms, a plurality of keyed spools mounted along the shaft, whereby, after endless wire is suspended from each of the spools, slotted preformed blocks are placed around the wire and fastened to the wire and adjacent blocks by clipping means thereby forming a mat, and means for lowering the endless mat in place as at least one row of blocks is clipped into place.

2. The apparatus as described in claim 1 wherein the means for fastening each block to the laterally adjacent block is a U-shaped clip inserted in holes preformed in the block.

3. The apparatus as described in claim 1 wherein the means for fastening each block to the wire and to the adjacent vertically disposed block is an omega shaped clip.

4. The apparatus as described in clam 1 wherein the means for lowering the mat is a clutched reduction gear.

5. The apparatus as described in claim 1 wherein each of the spools is individually clutched so that the mat may be lowered on a non-uniform bottom.

6. The apparatus as described in claim 1 wherein a motor drive means is included to wind the wire onto the spools.

7. The apparatus as described in claim 1 wherein the blocks in the mat formed by the apparatus are hollow and made of precast concrete.

8. The apparatus as described in claim 1 wherein the blocks in the mat formed by the apparatus are solid and made of precast concrete.

9. Method of forming and laying an endless, flexible underwater mat consisting of wire and preformed blocks which comprises:

suspending a plurality of endless cables from spools mounted on a horizontal shaft;

supporting the shaft over the edge of a mat laying barge;

placing slotted blocks on each of the suspended wires;

clipping each of the blocks to all of the adjacent blocks and to the suspended wires;

and gradually lowering the mat into place on the bottom of the water.

* * * * *